United States Patent [19]

Bullock

[11] Patent Number: 4,784,296

[45] Date of Patent: Nov. 15, 1988

[54] CAP FOR KEG DISPENSER

[75] Inventor: Joseph J. Bullock, Atherton, Calif.

[73] Assignee: Cap Snap Co., San Jose, Calif.

[21] Appl. No.: 82,938

[22] Filed: Aug. 6, 1987

Related U.S. Application Data

[63] Continuation of Ser. No. 816,063, Jan. 3, 1986, abandoned.

[51] Int. Cl.[4] ..... B67B 5/00

[52] U.S. Cl. ..... 222/153; 222/542; 215/256

[58] Field of Search ..... 222/153, 541, 562, 542, 222/543; 215/256; 220/27

[56] References Cited

U.S. PATENT DOCUMENTS

| | | | |
|---|---|---|---|
| 3,032,226 | 5/1962 | Terwilliger | 215/256 |
| 3,684,124 | 8/1972 | Song | 222/153 |
| 3,812,993 | 5/1974 | Yoshioka et al. | 215/256 |
| 3,812,994 | 5/1974 | Feldman | 215/256 |
| 4,166,552 | 9/1979 | Faulstich | 215/256 |
| 4,303,167 | 12/1981 | Martinez | 215/256 |
| 4,437,593 | 3/1984 | Bullock, III | 222/541 |
| 4,522,308 | 6/1985 | Sullivan | 215/256 |
| 4,678,094 | 7/1987 | Bullock | 215/256 |

FOREIGN PATENT DOCUMENTS

| | | | |
|---|---|---|---|
| 1475639 | 7/1965 | France | 222/541 |
| 728681 | 9/1965 | Italy | 222/153 |

*Primary Examiner*—Joseph J. Rolla
*Assistant Examiner*—Kenneth Noland
*Attorney, Agent, or Firm*—Julian Caplan

[57] ABSTRACT

A wine or beer keg dispenser spout has a curved exterior bead terminating in an outward-downward slanted surface, then a cylindrical surface and a horizontal shoulder below the latter. A cap for the spout is of plastic having a top disk and a depending skirt which fits over and snugly engages the exterior of the spout, the lower edge of the skirt resting on the shoulder. A tab extends below the skirt at an acute angle to the bottom edge. The skirt is weakened in a score line which is an upper extension of the top edge of the tab and continues to a terminus above the bead. Pulling the tab tears the skirt along the score line to permit separation of the cap.

9 Claims, 1 Drawing Sheet

CAP FOR KEG DISPENSER

This is a continuation, of application Ser. No. 06/816,063 filed Jan. 3, 1986, now abandoned.

BACKGROUND OF THE INVENTION

1. Field of the Invention

This invention relates to a new and improved plastic tamper-proof cap used as a closure for keg dispenser spouts, having a slanted tear tab projecting beyond the lower edge of the cap. The invention also relates to the combination of such a cap and a keg dispenser spout.

2. Description of Related Art

Plastic caps having slanted tear tabs are shown in U.S. Pat. No. 3,974,962 and British patent No. 816,787. In both these references a tear line in the skirt is substantially a continuation of the upper edge of the tear tab. However such tear line does not extend into the area adjacent the top disk of the cap and hence does not have many of the advantages of the present invention.

Tear lines which slant either to the right or the left are also known in the art. However the particular features of the present invention hereinafter described are not incorporated with tear lines extending in either direction.

SUMMARY OF THE INVENTION

The cap is characterized by the fact that it has a tear tab projecting downwardly from the bottom edge of the cap skirt at an angle of approximately 30 degrees, which tab is gripped by the consumer and torn upwardly. Adjacent the upper slanted edge of the tab extending into the wall of the skirt as a continuation of said upper edge of the tab is a score line. When the tab is pulled, the skirt tears along the score line. The upper terminus of the score line is preferably slightly below the top disk of the cap but may be spaced downward from the disk. Alternatively, a horizontal score line may extend part way around the skirt parallel to but spaced below the top disk. By continued pulling of the tear tab the skirt tears circumferentially around the skirt. The circumferential tearing of the skirt is confined to the area near the top of the cap by reason of the fact that there is a thickening or locking bead below such area. The skirt need not be torn completely off the top disk, which is particularly advantageous where the container is returned to a filling station. In such instances, after the contents of the container have been dispensed the partially torn cap may be reinstalled and this protects the lip of the container from damage during transit.

A preferred use of the present invention is as a tamper-resistant cover for the spout of a wine keg or beer keg. The cover serves to cover the spout from contamination. The cover is torn away to dispense the keg. Tearing the cap indicates possibility of tampering. Later, it may be placed on the spout to prevent damage to the latter during storage and transportation back to the filling station.

Other objects of the present invention will become apparent upon reading the following specification and referring to the accompanying drawings in which similar characters of reference represent corresponding parts in each of the several views.

DESCRIPTION OF PREFERRED EMBODIMENTS

Figure 1:
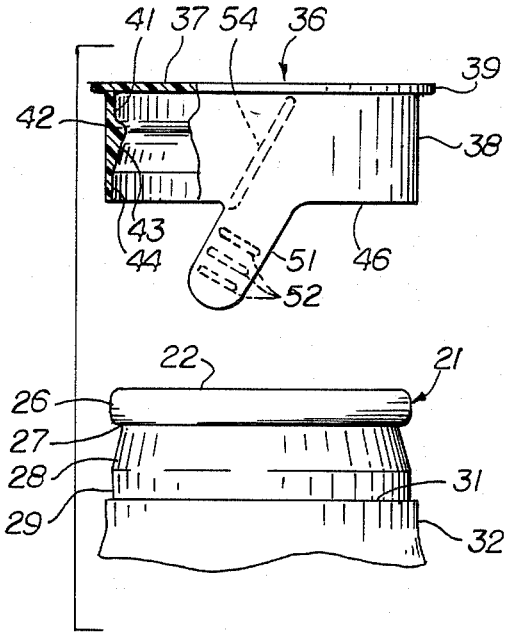
FIG. 1 is an exploded view partially broken away in section to reveal internal construction of the top of the spout of a wine dispenser keg and a cap in accordance with the present invention.

Directing attention to the embodiment depicted in FIG. 1, a wine keg dispenser spout 21 is shown. Similar spouts are used with beer kegs. It will be understood that the structure of this spout is subject to considerable variation. In the particular form of the invention shown in FIGS. 1 and 2, spout neck 21 has a rounded top lip 22. Internally, below lip 22 is an inner wall 23 which is substantially vertical. The neck 21 has incorporated therein or inserted therein a dispenser tube and dispenser valve (not shown).

The exterior of neck 21 has an outer curved edge 26 which is substantially semicircular in cross-section. Below edge 26 is a groove 27 of semicircular outline which merges with an outward downward slanted surface 28. Below surface 28 is an indented vertical surface 29 having a shoulder 31 above the remainder of the neck 32, not shown in detail.

Figure 2:
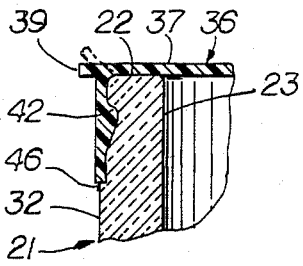
FIG. 2 is a fragmentary sectional view showing the cap and neck of FIG. 1 in seated position.

Cap 36 to be installed on neck 21 or a neck of similar external configuration has a top disk 37, the under side of which fits on the lip 22. Below disk 37 is a skirt 38 having a substantially vertical outer surface. Projecting beyond the skirt 38 as an extension of the disk 37 is a peripheral flange 39 which may be used to pry off the cap 36 after it has been torn. The use of flange 39 is optional, since the torn part of the cap, which adheres to the remainder, may be pulled to remove said remainder. The flange 39 may be rigid. Alternatively, as shown in FIG. 2, the flange 39 may be flexible to inhibit pulling cap 36 off the spout 21 before skirt 38 has been torn.

The interior of skirt 38 has a curved surface 41 immediately below disk 37 which is complementary to the edge 26. Bead 42 below curved surface 41 is shaped to snap into the groove 27 and seat the cap in place as best shown in FIG. 2. Bead 42 may be continuous or it may be interrupted as are either of the beads shown in U.S. Pat. No. 4,166,552. Below bead 42 is an outward downward slanted surface 43 terminating in a vertical wall 44 which extends to the bottom edge 46 of skirt 38. The bottom edge 46 fits onto shoulder 31, inhibiting entrance of dirt and also making it difficult to pry off cap 36 before the skirt is torn.

Extending downwardly at about a 30° angle below bottom edge 46 is a tear tab 51. The underside of tab 51 may be formed with a plurality of transverse gripping ribs or detents 52. The ribs 52 make it easier for the user to grasp the tab 51. Tab 51 may be bent outward to provide easier access to pull the same.

The inside of the skirt 38 is weakened in a slanted tear line 54 which extends parallel to the upper edge of tab 51 to a terminus immediately under the disk 37. The wall thickness between the bottom of groove 54 and the outside of skirt 38 is preferably uniform from the bottom edge 46 to the upper terminus of line 54. Hence where the bead enlargement 42 is intersected by the line 54, there are transition areas 56 slanting outwardly. Although groove 54 preferably extends up close to disk 37, it may terminate lower, although preferably above bead enlargement 42.

Accordingly, when the user grips the tab 51 and pulls upward, the skirt 38 tears along the line 54 and continued pulling on the tab 51 causes the skirt to tear-circumferentially below the disk 37. Tearing the skirt 38 is essential to removal of the cap 36 and such tearing gives evidence of the possibility of tampering with the contents of the keg. The skirt may be totally torn away in this manner but preferably it is torn only partially. The partially torn away portion may be used to pull the remainder of the cap off the neck. The partially torn cap may be reinstalled on the spout 21 to maintain cleanliness. Further, when the wine keg is to be returned to the filling station, the torn cap 36 may be reinstalled, thereby protecting the rim 22 from damage during transit.

Figure 3:
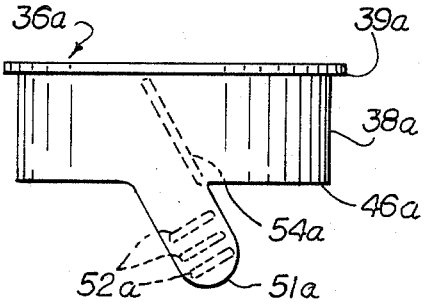
FIG. 3 is a side elevational view of a modified cap wherein the tab and tear line slant in a direction opposite that of FIG. 1.

In FIG. 3 cap **36*a* is shown similar to the cap 36 of FIGS. 1 and 2, except that the tab 51*a* slants in the opposite direction, as does the score line 54*a*. In other respects the cap of FIG. 3 is similar to that of FIG. 1** and the same reference numerals followed by the subscript a are used to identify corresponding parts.

Figure 5:
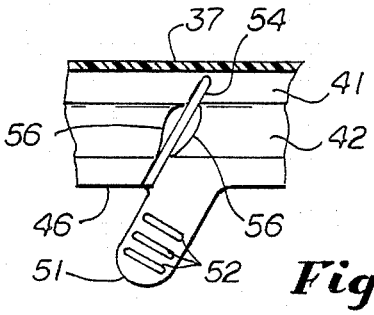
FIG. 5 is a fragmentary sectional view showing a further modification wherein the inside of the skirt is enlarged to ensure that the skirt is torn along the tear line.
Figure 5A:
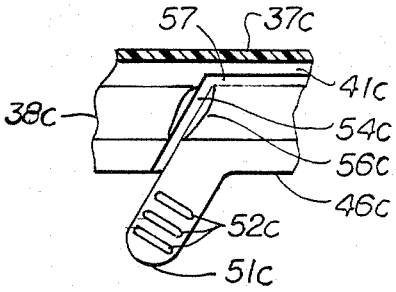
FIG. 5A is a view similar to FIG. 5 of another modification.

In FIG. 5 a horizontal score line 57 extends from the upper end of line 54 circumferentially at least part way around skirt **38*c*. Line 57 is spaced below but parallel to the underside of disk 37*c***.

Figure 6:
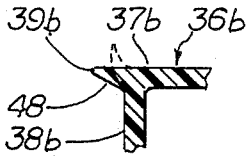
FIG. 6 is a fragmentary sectional view through a corner of a cap having a modified flange.

Directing attention to FIG. 6, it will be understood that the flange 39 of FIG. 1 may be modified by a triangular flange **39*b* having a downward inward slanted surface 48. Flange 39*b*** is preferably rigid but may be flexible, as shown by dotted lines.

Figure 7:
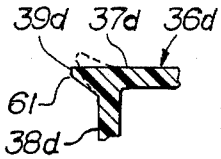
FIG. 7 is a view similar to FIG. 6 of a further modified flange.
Figure 4:
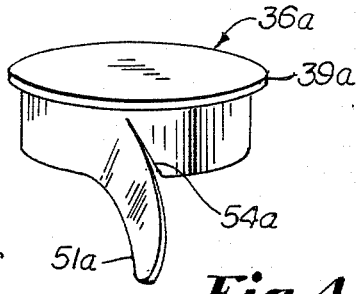
FIG. 4 is a perspective view of the cap of FIG. 3 partially torn away.

The flange of FIG. 7 resembles that of FIG. 6 except that the triangular shape of flange **39*d* is truncated by a short vertical surface 61. Again, flange 39*d*** is preferably rigid but may be flexible, as shown by dotted lines.

Figure 8:
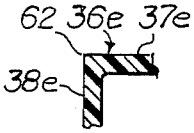
FIG. 8 is a fragmentary sectional view of the corner of a cap having no flange.

FIG. 8 illustrates the absence of any flange, there being a substantially right-angle corner 62 at the intersection of the top of disk **37*c* and the outside of skirt 38*e*. Particularly when the skirt is only partially torn away from the disk, the partially torn away portion of the skirt may be used as a handle to pull the cap 37*e*** off the neck of the container.

Figure 9:
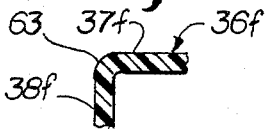
FIG. 9 is a view similar to FIG. 8 of a cap having a rounded corner.

In FIG. 9 the corner 63 is rounded, but in other respects cap **36*f* resembles cap 36*c* of FIG. 8**.

In other respects the caps of FIGS. 3, 6, 5A, 7, 8 and 9 resemble those of the preceding modifications and the same reference numerals followed by subscripts a, b, c, d, e and f, respectively, are used to designate corresponding parts.

What is claimed is:

1. A cap formed of a resilient plastic capable of being torn for use on a container neck having a lip at its upper end and retaining means on its exterior, said retaining means being located substantially below said lip, said cap comprising a top disk, an elongated skirt depending vicinal the periphery of said disk having a bottom edge and horizontally disposed bead means on its interior spaced substantially upward relative to said bottom edge and substantially downward relative to said disk, said bead means being cooperable with said retaining means to secure said cap on said neck so long as said skirt is intact to resist tampering, said skirt having a tab extending downward and away from said bottom edge, said skirt being weakened by a score line substantially comprising an upward extension of the top edge of said tab, said score line having a terminus immediately below said disk and substantially above said bead means, said skirt having a thickness to either side of said terminus substantially greater than the thickness of said skirt at said score line, whereby upon pulling said tab said skirt tears along said score line, said disk guiding tearing of said skirt circumferentially immediately below said disk, to permit separation of said cap from said neck, said lip being sealed against the underside of said disk when said bead means and said retaining means are engaged.

2. A cap according to claim 1 wherein said tab is formed with a plurality of transverse gripping ribs on its underside.

3. A cap according to claim 1 in which said tab extends at an acute angle with respect to said bottom edge.

4. A cap according to claim 1 wherein said bead means is intersected by said score line and having transition areas slanting outwardly from said score line.

5. A cap according to claim 4 characterized by a square corner at the intersection of the projections of the top of said disk and the outside of said skirt.

6. A cap according to claim 4 characterized by a rounded corner at the intersection of the projections of the top of said disk and the outside of said skirt.

7. In combination, a container neck having a lip at its end having on its exterior a semi-circular bead located substantially below said lip terminating in a semi-circular groove terminating in an outward-downward slanted surface, a cylindrical surface and a horizontal shoulder and a cap formed of a resilient plastic capable of being torn comprising a top disk, an elongated skirt depending vicinal the periphery of said disk having a bottom edge and horizontally disposed bead means on its interior spaced substantially upward relative to said bottom edge and substantially downward relative to said disk, said bead means being cooperable with said retaining means to secure said cap on said neck so long as said skirt is intact to resist tampering, said skirt having a tab extending downward and away from said bottom edge, said skirt being weakened by a score line substantially comprising an upward extension of the top edge of said tab, said score line having a terminus immediately below said disk and substantially above said bead means, said skirt having a thickness to either side of said terminus substantially greater than the thickness of said skirt at said score line, whereby upon pulling said tab said skirt tears along said score line, said disk guiding tearing of said skirt circumferentially immediately below said disk, to permit separation of said cap from said neck, said bead means of said cap being complementary to said groove and said slanted surface of said neck, the inside of said skirt below said bead means being dimensioned to fit snugly around said cylindrical surface, said bottom edge resting on said shoulder, said lip being sealed against the under side of said disk when said bead means and said retaining means are engaged.

8. The combination of claim 7 in which said tab extends at an acute angle with respect to said bottom edge.

9. A combination according to claim 7 wherein said bead means is intersected by said score line having transition areas slanting outwardly from said score line.

* * * * *